US008807686B2

(12) United States Patent
Murai

(10) Patent No.: US 8,807,686 B2
(45) Date of Patent: Aug. 19, 2014

(54) PRINTING DEVICE AND PRINTING METHOD USING THE SAME

(75) Inventor: Kosuke Murai, Nagano (JP)

(73) Assignee: Mimaki Engineering Co., Ltd., Nagano (JP)

( * ) Notice: Subject to any disclaimer, the term of this patent is extended or adjusted under 35 U.S.C. 154(b) by 155 days.

(21) Appl. No.: 13/516,231

(22) PCT Filed: Dec. 1, 2010

(86) PCT No.: PCT/JP2010/071514

§ 371 (c)(1),
(2), (4) Date: Jun. 14, 2012

(87) PCT Pub. No.: WO2011/074420

PCT Pub. Date: Jun. 23, 2011

(65) Prior Publication Data

US 2012/0249658 A1 Oct. 4, 2012

(30) Foreign Application Priority Data

Dec. 18, 2009 (JP) ..... 2009-288137

(51) Int. Cl.

| | |
|---|---|
| ***B41J 2/205*** | (2006.01) |
| ***B41J 2/21*** | (2006.01) |
| ***B41J 29/38*** | (2006.01) |
| ***B41J 29/393*** | (2006.01) |

(52) U.S. Cl.

CPC ..... *B41J 2/2114* (2013.01); *B41J 2/2142* (2013.01); *B41J 29/38* (2013.01); *B41J 29/393* (2013.01)

USPC ..... 347/15; 347/19; 347/43

(58) Field of Classification Search

USPC ..... 347/14–16, 19, 21, 43–45

See application file for complete search history.

(56) References Cited

U.S. PATENT DOCUMENTS

| | | | | |
|---|---|---|---|---|
| 8,446,633 | B2 * | 5/2013 | Watanabe | 358/1.9 |
| 8,562,107 | B2 * | 10/2013 | Tamai et al. | 347/41 |
| 2002/0113968 | A1 * | 8/2002 | Parisi et al. | 356/399 |
| 2006/0139705 | A1 * | 6/2006 | Piatt et al. | 358/504 |
| 2008/0150987 | A1 * | 6/2008 | Yamanobe | 347/12 |
| 2010/0060682 | A1 * | 3/2010 | Akatsuka | 347/9 |
| 2010/0214340 | A1 * | 8/2010 | Sugahara et al. | 347/14 |

FOREIGN PATENT DOCUMENTS

| | | |
|---|---|---|
| JP | 09-304992 | 11/1997 |
| JP | 2004-195862 | 7/2004 |
| JP | 2007-253565 | 10/2007 |
| JP | 2009-051095 | 3/2009 |

* cited by examiner

*Primary Examiner* — Stephen Meier
*Assistant Examiner* — Sharon A Polk
(74) *Attorney, Agent, or Firm* — Jianq Chyun IP Office

(57) ABSTRACT

Including either a platen or a flat bed, and a printer head; the printing device is configured in such a way as to print by making a combination of a reciprocating motion of the printer head and an operation of discharging ink toward a white medium. Meanwhile, the printer head includes a plurality of heads individually corresponding to each color. The printing device includes a control unit for setting a test pattern for testing each color, and pattern print areas where the test pattern is printed. The control unit makes a setting in such a way that, for the pattern print area where a test pattern is printed by discharging white ink of a nearly-identical color as a color of the white medium, the test pattern is printed with the white ink on a primer print prepared with black ink.

3 Claims, 7 Drawing Sheets

PRINTING DEVICE AND PRINTING METHOD USING THE SAME

CROSS-REFERENCE TO RELATED APPLICATION

This application is a 371 of international application of PCT application serial no. PCT/JP2010/071514, filed on Dec. 1, 2010, which claims the priority benefit of Japan application no. 2009-288137, filed on Dec. 18, 2009. The entirety of each of the above-mentioned patent applications is hereby incorporated by reference herein and made a part of this specification.

FIELD OF THE INVENTION

The present invention relates to a printing device for printing operation by way of discharging ink from a discharge nozzle of a printer head, and a printing method by using the same.

BACKGROUND

As the printing device (ink jetprinter) described above, those of various types of configurations are conventionally known. For example, known is a configuration including a platen for supporting a sheet medium, and a printer head placed above the platen in such a way as to face the platen. A printer head is provided for each color; for example, magenta (M), yellow (Y), cyan (C), and black (K); and then a lot of discharge nozzles are built at a side facing the platen. In the case of a printing device having such a configuration, while making a combination of a motion of a printer head reciprocating from left side to right side and a motion of a medium relatively moving back and forth in a direction perpendicular to the reciprocating direction of the printer head, the printing device takes control of discharging ink (ink drops) from the discharge nozzles toward the medium supported by the platen in order to carry out printing work on a surface of the medium as required.

In recent years, each of the discharge nozzles described above is so shaped as to make its diameter very small in order to enable a delicate color representation by way of discharging fine ink drops. In the meantime, the ink is exposed to air at a tip of the discharge nozzle. If such a condition lasts for a long time, the ink is dried so as to become hardened at the tip of the discharge nozzle, and result in a condition of a clogged nozzle sometimes, in which no ink is discharged from the tip of the discharge nozzle. Especially, in the case of a discharge nozzle shaped so as to have a very small diameter, owing to its structure, the condition of a clogged nozzle is prone to develop easily. If printing operation is carried out under such a condition, a clogged discharge nozzle does not discharge the ink. As a result, there come up missing dots so that it becomes difficult to produce a printed material as required.

In a conventional way of printing work, a certain test pattern is printed on a medium, and then an ink discharge condition of each discharge nozzle (i.e., whether the nozzle is clogged or not) is checked before a start of printing work by means of visually examining the printed test pattern. In ordinary printing work, a white-colored medium (white medium) is often used. Then, if a test pattern is printed on a white medium, as it is, by discharging magenta ink, yellow ink, cyan ink, and black ink, an ink discharge condition can easily be checked since the medium color is different from each ink color.

Recently, developed for more expressive color representation is a printing device provided with a configuration including an additional printer head for discharging white ink (W), besides printer heads for the above 4 colors (magenta, yellow, cyan, and black) (For example, refer to Patent Document 1).

PRIOR ART DOCUMENT

Patent Document

[Patent Document 1] Japanese Unexamined Patent Application Publication No. 2007-253565

SUMMARY OF INVENTION

Problems to Be Solved

Incidentally, when the above-described printing device including the additional printer head for white ink prints a test pattern on a white medium that is often used in ordinary printing work, the test pattern printed with magenta ink, yellow ink, cyan ink, and black ink can clearly be checked, and meanwhile checking the test pattern printed with white ink is associated with difficulty since the medium is colored in white. Then, at the time of checking the discharge condition, the white medium for printing work is once replaced with a transparent medium for printing a test pattern, and the test pattern is printed on the transparent medium for checking it. Therefore, each time when the discharge condition is checked, unfortunately it is needed to replace the medium of the printing device so that the checking work is likely to become complicated. Furthermore, unfortunately the medium replacement work consumes a relatively long time, and therefore work efficiency of entire printing work is prone to become reduced.

It is an object of the present invention to provide a printing device in which an ink discharge condition of a printer head can easily be checked so as to improve work efficiency, as well as a printing method by using the printing device.

Means to Solve the Problems

To accomplish the object described above, a printing device according to the present invention includes: a medium supporting means (for example, the platen 12*a*, or the flat bed in the embodiments) for supporting a sheet print medium (for example, the medium 'M', or the white medium 'WM' in the embodiments); a printer head, installed to a guide rail (for example, the guide rail 15*a* in the embodiments) in such a way as to freely reciprocate, for discharging ink from a discharge nozzle so formed as to face downward, the guide rail being provided at a position above the medium supporting means; and a test print setting means (for example, the control unit 40 in the embodiments) for setting a test pattern of each color to be printed by discharging ink from the discharge nozzle, and a pattern print area in the print medium where the test pattern is printed; wherein the printing device prints on the print medium by making a combination of a motion of the printer head reciprocating along the guide rail and an operation of discharging ink from the discharge nozzle toward the print medium supported by the medium supporting means; the printer head includes a plurality of specific-color printer heads individually corresponding to each color (for example, the black head 22K, the magenta head 22M, the yellow head 22Y, the cyan head 22C, and the white head 22W in the embodiments); and the test print setting means makes a setting in such a way that, for the pattern print area where the test pattern is printed by discharging ink of a nearly-identical color as a color of the print medium, the test pattern is printed with the ink of the nearly-identical color on a primer print prepared with ink of a color other than the nearly-identical color.

In the printing device described above, preferably the printer head includes at least one of the specific-color printer heads, for discharging black ink, as well as another one of the specific-color printer heads, for discharging white ink; and the test print setting means makes a setting in such a way that, for the pattern print area where the test pattern is printed by discharging white ink onto a white medium, the test pattern is printed with the white ink on a primer print prepared with the black ink.

A printing method according to the present invention uses a printing device for printing on a print medium by making a combination of a motion of a printer head reciprocating along a guide rail and an operation of discharging ink from a discharge nozzle of the printer head toward the print medium supported by a medium supporting means, the guide rail being positioned above the medium supporting means for supporting the print medium; and the printing method includes: a first step in which, for a pattern print area where a test pattern is printed by discharging ink of a nearly-identical color as a color of the print medium, a primer print is prepared with ink of a color other than the nearly-identical color; and a second step in which the test pattern is printed with the ink of the nearly-identical color on the primer print prepared in the first step.

Advantageous Effect of the Invention

Settings are made by a test print setting means in a printing device according to the present invention in such a way that; for a pattern print area where a test pattern is printed with ink of a nearly-identical color as a color of a print medium, the test pattern is printed with the ink of the nearly-identical color as the color of the print medium, on a primer print prepared with ink of a color other than the nearly-identical color. Therefore, at the time of checking for any clogged nozzle; without replacing the print medium of the printing device, it becomes possible to check for any clogged nozzle in a printer head that discharges the ink of the nearly-identical color as the color of the print medium. Accordingly, the checking work can easily be carried out, and furthermore it becomes possible to improve work efficiency of entire printing work.

In the case where a white print medium is used, preferably the test print setting means makes a setting in such a way that; for a pattern print area where a test pattern is printed by discharging white ink, the test pattern with the white ink is printed on a primer print prepared with black ink. According to this configuration, since the white color and the black color are in their relation of complementary colors each other, the test pattern with the white ink on the black primer print can clearly be checked, and therefore a clogged nozzle can be detected for sure.

A printing method according to the present invention includes: a first step in which, for a pattern print area where a test pattern is printed with ink of a nearly-identical color as a color of a print medium, a primer print is prepared with ink of a color other than the nearly-identical color; and a second step in which the test pattern is printed with the ink of the nearly-identical color on the primer print prepared in the first step. Accordingly, although it is a simple method including just a slight modification with respect to the control at the time of printing the test pattern without any additional new component and the like, the printing method enables easy checking work without replacing the medium so that it becomes possible to improve work efficiency of entire printing work.

BRIEF DESCRIPTION OF THE DRAWINGS

FIG. 3A through FIG. 3C are explanatory drawings showing test pattern printing steps according to a first embodiment, wherein FIG. 3A shows a situation in the middle of printing a primer, FIG. 3B shows a situation just before printing a test pattern, and FIG. 3C shows a situation after printing the test pattern.

FIG. 4A and FIG. 4B are magnified views of parts of test patterns, wherein FIG. 4A shows a situation free from any clogged nozzle, and FIG. 4B shows a situation of having a clogged nozzle.

FIG. 6A through FIG. 6C are explanatory drawings showing test pattern printing steps according to a second embodiment, wherein FIG. 6A shows a situation before printing a primer, FIG. 6B shows a situation after printing the primer, and FIG. 6C shows a situation after printing a test pattern.

FIG. 7A through FIG. 7C are explanatory drawings showing test pattern printing steps according to a third embodiment, wherein FIG. 7A shows a situation before printing a primer, FIG. 7B shows a situation after printing the primer, and FIG. 7C shows a situation after printing a test pattern.

DESCRIPTION OF THE PREFERRED EMBODIMENTS

Figure 1:
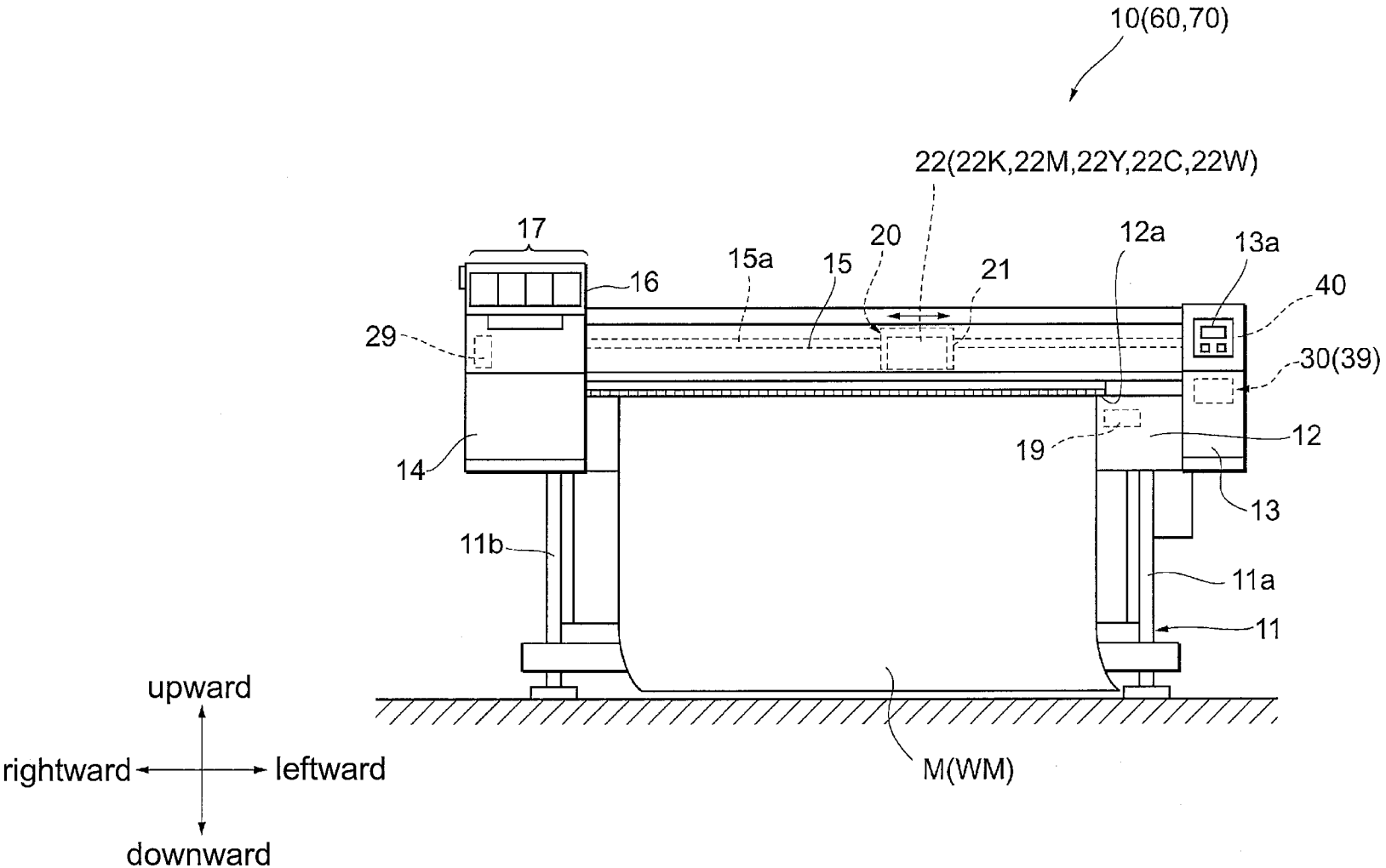
FIG. 1 is a front elevation view of a printing device according to the present invention.

Preferred embodiments according to the present invention are described below with reference to the accompanying drawings. At first, a general configuration of a printing device 10, to which the present invention is applied, is explained with reference to FIG. 1 and FIG. 2. Incidentally, a frontward direction, a backward direction, a rightward direction, a leftward direction, an upward direction, and a downward direction of the printing device 10 are indicated with arrows on the drawing for convenience of explanation. Then, explanation is made below by using expression of these directions.

As shown in FIG. 1, the printing device 10 includes: a supporting leg 11 having a leftward leg 11*a*, and a rightward leg 11*b*; a center body section 12 supported by the supporting leg 11; a left body section 13 provided at a left side of the center body section 12; a right body section 14 provided at a right side of the center body section 12; and an upper body section 15 that connects the left body section 13 and the right body section 14, and also stretches in parallel with the center body section 12, while being positioned over, and apart from the center body section 12. Operation of each unit in the printing device 10 is controlled by a control unit 40 installed in the left body section 13 (more details are explained later).

Inside the upper body section 15, provided is a guide rail 15*a* stretching in a left-and-right direction, and meanwhile a head unit 20 is installed onto the guide rail 15*a*. The head unit 20 includes: a carriage 21 that is so assembled onto the guide rail 15*a* as to be movable in the left-and-right direction; and a printer head 22 mounted on the carriage 21. The printer head 22 includes, for example: a black head 22K for discharging black ink, a magenta head 22M for discharging magenta ink, a yellow head 22Y for discharging yellow ink, a cyan head 22C for discharging cyan ink, and a white head 22W for discharging white ink. At a bottom surface of the printer head 22, there are formed a plurality of discharge nozzles (not shown) for discharging ink downward to a medium 'M'. For example, where a line of nozzles is formed by linearly placing 180 discharge nozzles in a front-back direction, 8 lines of such nozzles are placed in a left-and-right direction. Discharging the ink at each discharge nozzle is controlled with a drive control signal output from the control unit 40 to each head of the printer head 22.

A platen 12*a* is so provided as to be exposed on a top surface of the center body section 12, the platen 12*a* being shaped like a flat plate and stretching in a left-and-right direction. Then, a transfer roller (not shown) stretching in a left-and-right direction is so provided as to be exposed at a back side of the platen 12*a*. The transfer roller is driven so as to rotate by a back-and-forth driving motor 19 provided in the center body section 12. Therefore, while the medium 'M', i.e., a sheet medium as an object of printing work, is pinched between a pinch roller (not shown) provided in the upper body section 15 and the transfer roller, the medium 'M' can be transferred for a transfer distance according to a drive control variable in a front-back direction by means of driving the back-and-forth driving motor 19 according to the drive control signal output from the control unit 40.

A cartridge housing section 16 is provided in an upper part of the right body section 14, and a plurality of ink cartridges 17 are inserted in front and rear portions of the cartridge housing section 16. The cartridge housing section 16 is connected to the printer head 22 by way of a supply tube (not shown). Then, according to the amount of ink consumption at the printer head 22, the ink of the ink cartridges 17 is supplied to the printer head 22 by way of the supply tube. Furthermore, a horizontally (left-and-right) driving motor 29 for driving the head unit 20 in a left-and-right direction along the guide rail 15*a* is provided in the right body section 14. By means of driving the horizontally driving motor 29 according to a drive control signal from the control unit 40, the head unit 20 can be transferred for a transfer distance according to a drive control variable in a left-and-right direction.

An operation section 13*a* configured with operation switches, a display device, and so on is provided at a front side of the left body section 13. Furthermore, a maintenance unit 30 and the control unit 40 are provided in the left body section 13. The maintenance unit 30 includes: a cap component (not shown) that is open upward and so shaped as to meet a shape of a bottom side surface of the printer head 22; a suction pump (not shown); and a cap driving motor 39. By means of driving the cap driving motor 39 according to a drive control signal from the control unit 40, the cap component can be moved vertically for a transfer distance according to a drive control variable. Furthermore, by means of driving the suction pump, an internal area of the cap component can have a negative pressure.

Figure 2:
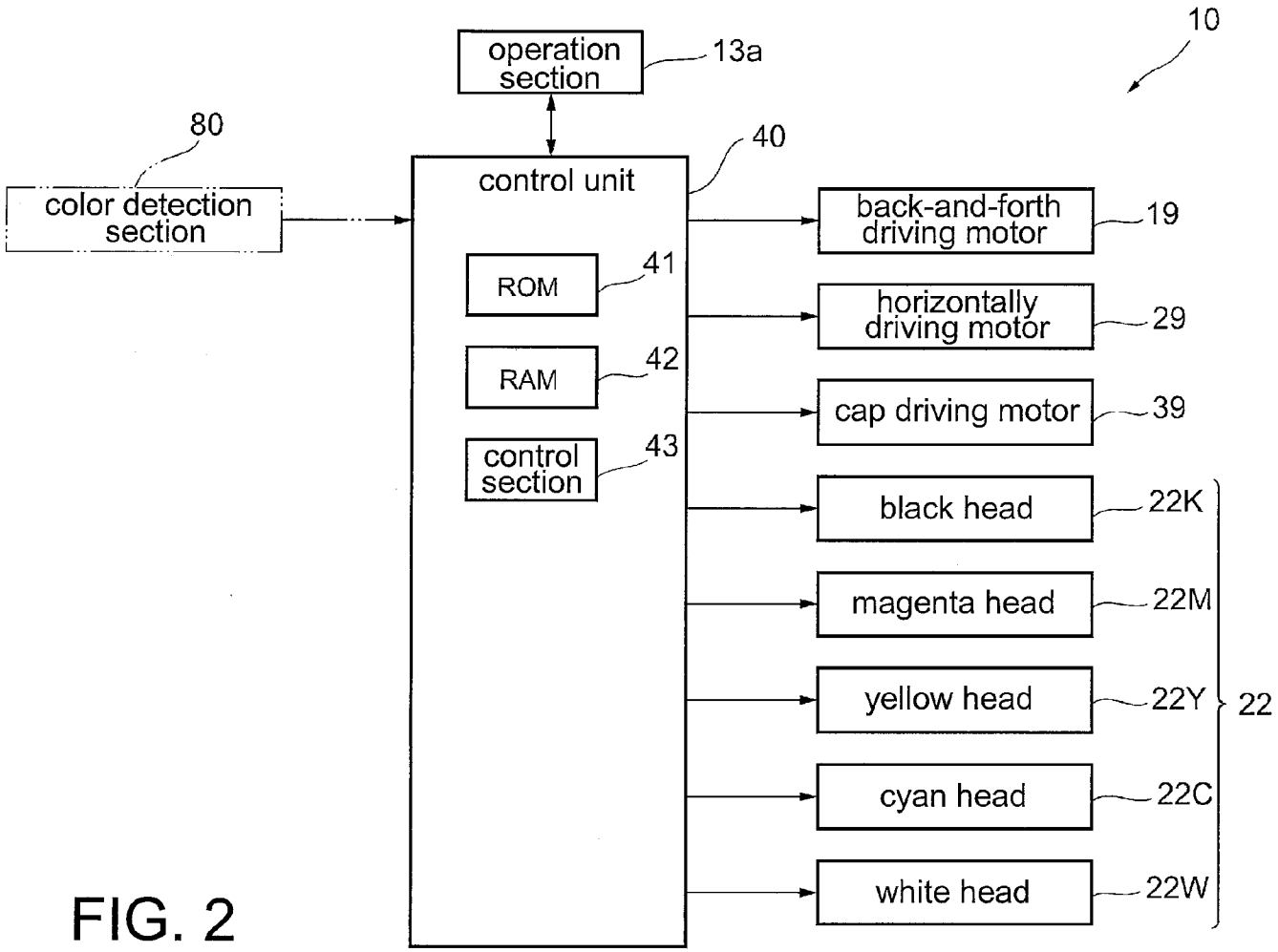
FIG. 2 is a control system diagram of the printing device described above.

As shown in FIG. 2, the control unit 40 includes: a ROM 41 in which a control program for controlling operation of each portion of the printing device 10 is written; a RAM 42 that temporarily stores a program and the like for printing on the medium 'M'; and a control section 43 that executes arithmetic processing with respect to a program read out from the RAM 42 as well as an operation signal input from the operation section 13*a*, and so on, and controls the operation of each portion according to the control program. Information (for example, ink color) in relation to the printer head 22 installed in the carriage 21 is written in the ROM 41. The control unit 40 outputs a drive control signal to the back-and-forth driving motor 19, the horizontally driving motor 29, the cap driving motor 39, the printer head 22, and the like on the basis of a result of arithmetic processing by the control section 43, so as to control operations of those components described above.

Described above is the general configuration of the printing device 10. In printing operation onto the medium 'M' by using the printing device 10 configured as described above; while a transfer motion of the medium 'M' in the front-back direction by using the back-and-forth driving motor 19, and a transfer motion of the head unit 20 in the left-and-right direction by using the horizontally driving motor 29 are executed in combination, the ink is discharged downward from the discharge nozzles of the printer head 22 toward the medium 'M' supported by the platen 12*a*. Through the operation described above, it is possible to produce a printed material as required.

Incidentally, for example in the case of turning on the power for the printing device 10 to start the printing work as described above, resuming the printing work as described above after once interrupting it, and a similar other case as well; sometimes there happens a situation of having a clogged nozzle, in which the ink at a tip of a discharge nozzle is exposed to air so as to become hardened, and eventually no ink is discharged from the tip of the discharge nozzle. Also, after a certain time period of continuous printing work, sometimes excess ink, dust, and the like adhere to a tip of a discharge nozzle so that it may become difficult to discharge an ink drop straight downward. If printing work is executed under such a situation of having a clogged nozzle and an ink drop not discharged straight, it becomes difficult to apply an ink drop to a position as controlled so that the printing quality eventually deteriorates. Therefore, it is necessary for a user to print a test pattern by means of discharging ink from each of discharge nozzles before a start of printing work, and/or at a convenient time in the middle of printing work, and visually check the test pattern printed in order to check for presence of any clogged nozzle.

At the time of such checking work, for example, if a test pattern is printed by discharging cyan ink onto a white-colored medium 'M' (a white medium 'WM'), a condition of the applied cyan ink (test pattern) can visually be checked with ease, since colors of the medium 'M' and the ink are different from each other. Meanwhile, if the test pattern is printed by discharging white ink, it becomes difficult to visually check a condition of the applied white ink accurately, since colors of the medium 'M' and the ink are the same. Thus, it is difficult to visually check a discharging condition when the test pattern is printed by discharging ink onto a medium 'M' of the same color as one of the colors of ink discharged from the printer head 22. Then, the printing device 10 according to the present invention is configured in such a way that the discharging condition of each color of ink can visually be checked with ease even though used is a medium 'M' of the same color as one of the colors of ink discharged from the printer head 22.

First Embodiment

The printing device 10 has the configuration described above as a characteristic configuration. Then, with additional reference to FIGS. 3A through 3C, FIG. 4A as well as FIG. 4B, the characteristic configuration is explained below in details in line with a flowchart shown in FIG. 5. Incidentally, a case of using a white-colored medium 'WM' is exemplified in the following explanation, since such a white-colored medium 'WM' is often used as the medium 'M' in practical printing work.

When checking for presence of any clogged nozzle and the like, at first, a user operates the operation section 13*a*, and inputs an operation command into the control unit 40. At the time, the user inputs a color of the white medium 'WM' (i.e., white) as an object of the printing work, which is mounted on the printing device 10, into the control unit 40 together with the command described above (Step S110 shown in FIG. 5).

Subsequently, operation progresses to a step S120, and the control unit 40 judges whether or not the printer head 22 mounted is without a printer head that discharges ink of the same color as the entered color of the white medium 'WM' (i.e., white). If it is judged that the printer head 22 is without any printer head to discharge the ink of the same color as the color of the white medium 'WM' (i.e., YES judged in a step S120), operation progresses to a step S140. Specifically to describe, if a medium 'M' of any color other than magenta, yellow, cyan, black, and white; e.g., a gray-colored or transparent medium 'M'; is mounted, and the color is input into the control unit 40, operation progresses not to a step S130 but directly to the step S140.

In the meantime, if it is judged that the entered color of the white medium 'WM' (i.e., white) is the same as one of the colors of the printer head 22, or so similar to one of the colors of the printer head 22 that visual discrimination is hardly possible (i.e., NO judged in a step S120), operation progresses to the step S130. In the case of the present embodiment, there exists the white head 22W that discharges the ink of the same color as the color of the white medium 'WM', and accordingly operation progresses to the step S130. At the time, the control unit 40 makes a setting in such a way that; a primer is printed in an area (a pattern print area 51) where a test pattern is printed (refer to FIG. 3A) by discharging white ink, for example with black ink which is in relation of a complementary color to white ink (both the colors highlighting each other), and then the test pattern with white ink is overprinted on the primer.

Figure 3A:
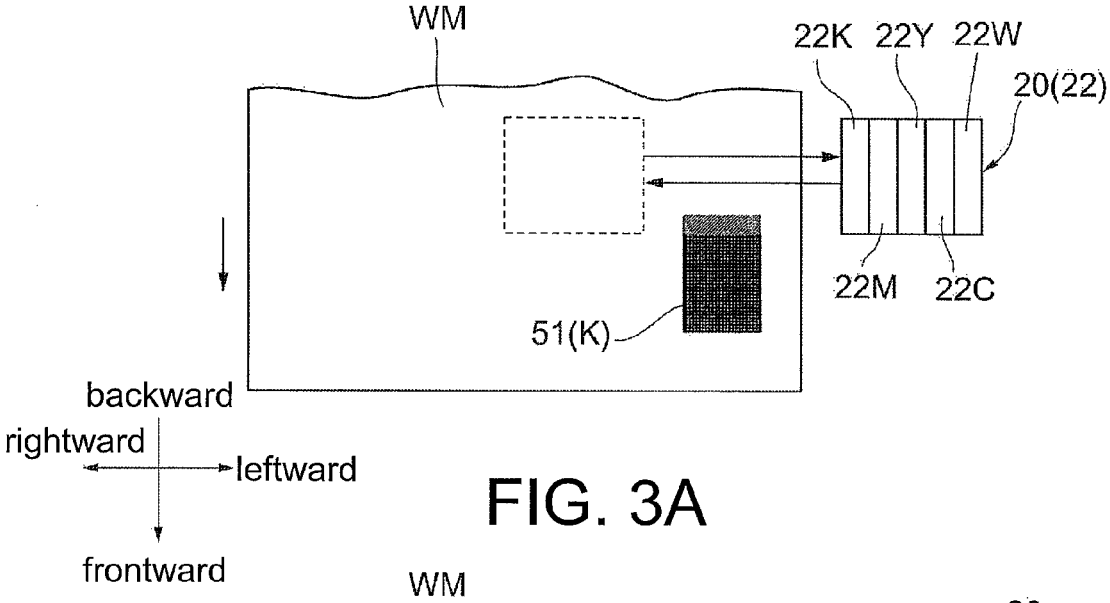
Figure 3B:
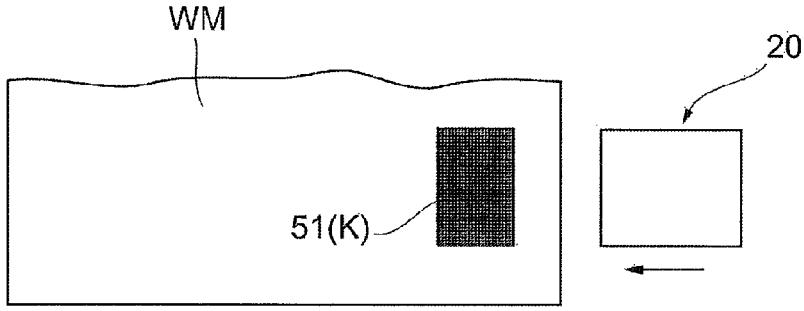
Figure 3C:
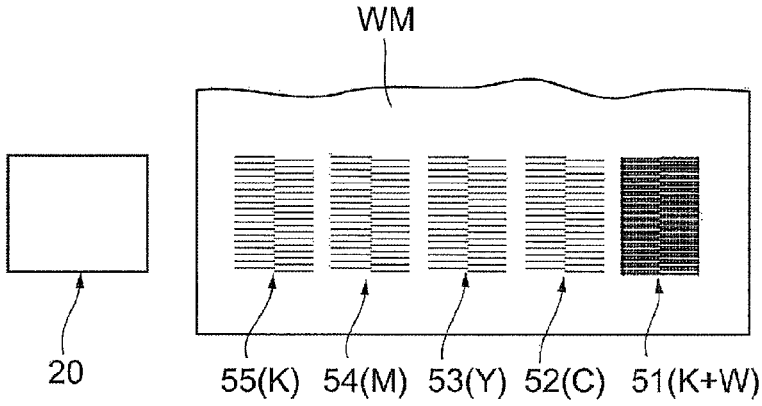

On the other hand, for areas where test patterns are printed with any ink other than white ink; namely, for a pattern print area 52 where a test pattern is printed with cyan ink, a pattern print area 53 where a test pattern is printed with yellow ink, a pattern print area 54 where a test pattern is printed with magenta ink, and a pattern print area 55 where a test pattern is printed with black ink; a setting is made in such a way that no primer is printed (refer to FIG. 3C). The reason is because a color of ink other than white ink is different from the color of the white medium 'WM', and therefore a test pattern printed by directly discharging the ink onto the white medium 'WM' can still visually be checked with ease.

In the step S130, while a motion of the head unit 20 reciprocating in the left-and-right direction and a motion of the white medium 'WM' moving forward are executed in combination according to the setting of the step S120, a black primer is printed by discharging black ink from the black head 22K on the pattern print area 51 where a test pattern is printed with white ink, as shown in FIG. 3A. Owing to the primer printing described above, the black ink is applied all over the pattern print area 51 (an entire section of the area). Incidentally, the primer printing is carried out so as to have the primer section somewhat longer than a length of the lines of nozzles of the printer head 22 in the front-back direction. After completion of the primer printing by using the black ink, operation progresses to the step S140. 'K' of '51K' shown in FIG. 3A represents a color of the black (K) ink applied to the pattern print area 51, and the same explanation is applied to FIG. 3B and FIG. 3C as well.

In the step S140, at first, the head unit 20 is positioned on the left side of the pattern print area 51, as shown in FIG. 3B. By means of controlling a discharge from each discharge nozzle while the head unit 20 is moving toward the right under the situation described above, test patterns are individually printed; i.e., a test pattern with the white (W) ink is printed on the pattern print area 51 where the primer has been printed with the black (K) ink; a test pattern with the cyan (C) ink is printed on the pattern print area 52; a test pattern with the yellow (Y) ink is printed on the pattern print area 53; a test pattern with the magenta (M) ink is printed on the pattern print area 54; and a test pattern with the black (K) ink is printed on the pattern print area 55. In the present embodiment, as shown in FIG. 3C, illustrated as an example are linear test patterns printed in such a manner as to stretch in the right-and-left direction, and then each line corresponds to each discharge nozzle.

In the pattern print area 51, the test pattern is printed on the primer print already prepared. Therefore, at the time when the test pattern is printed, preferably the primer print is already dry enough as much as possible, from a viewpoint of preventing the ink from bleeding. For that purpose, a drying time may be set within a period after completion of printing the primer until a start of printing the test pattern; and moreover a drying heater may be built in the platen 12*a*.

Figure 4A:
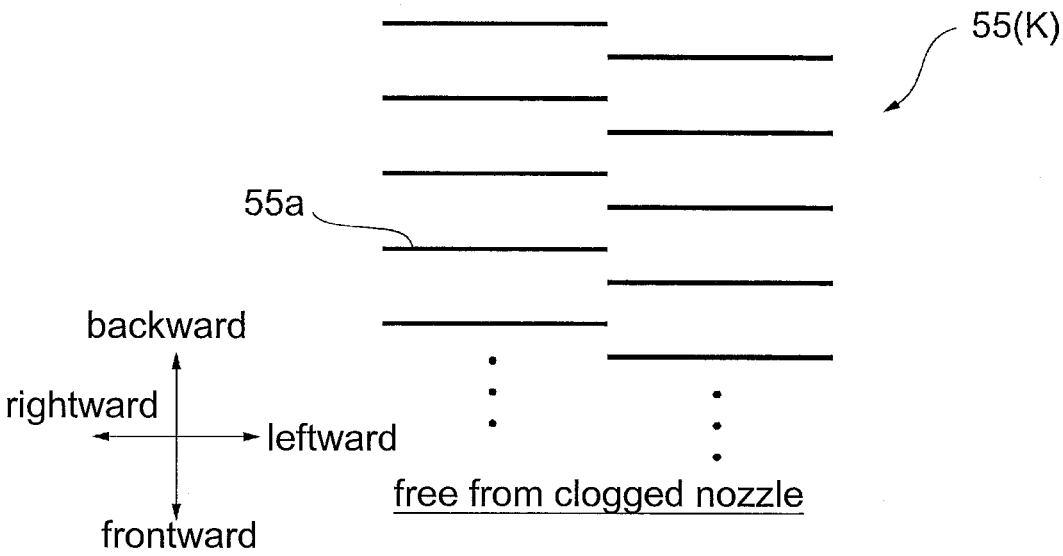
Figure 5:
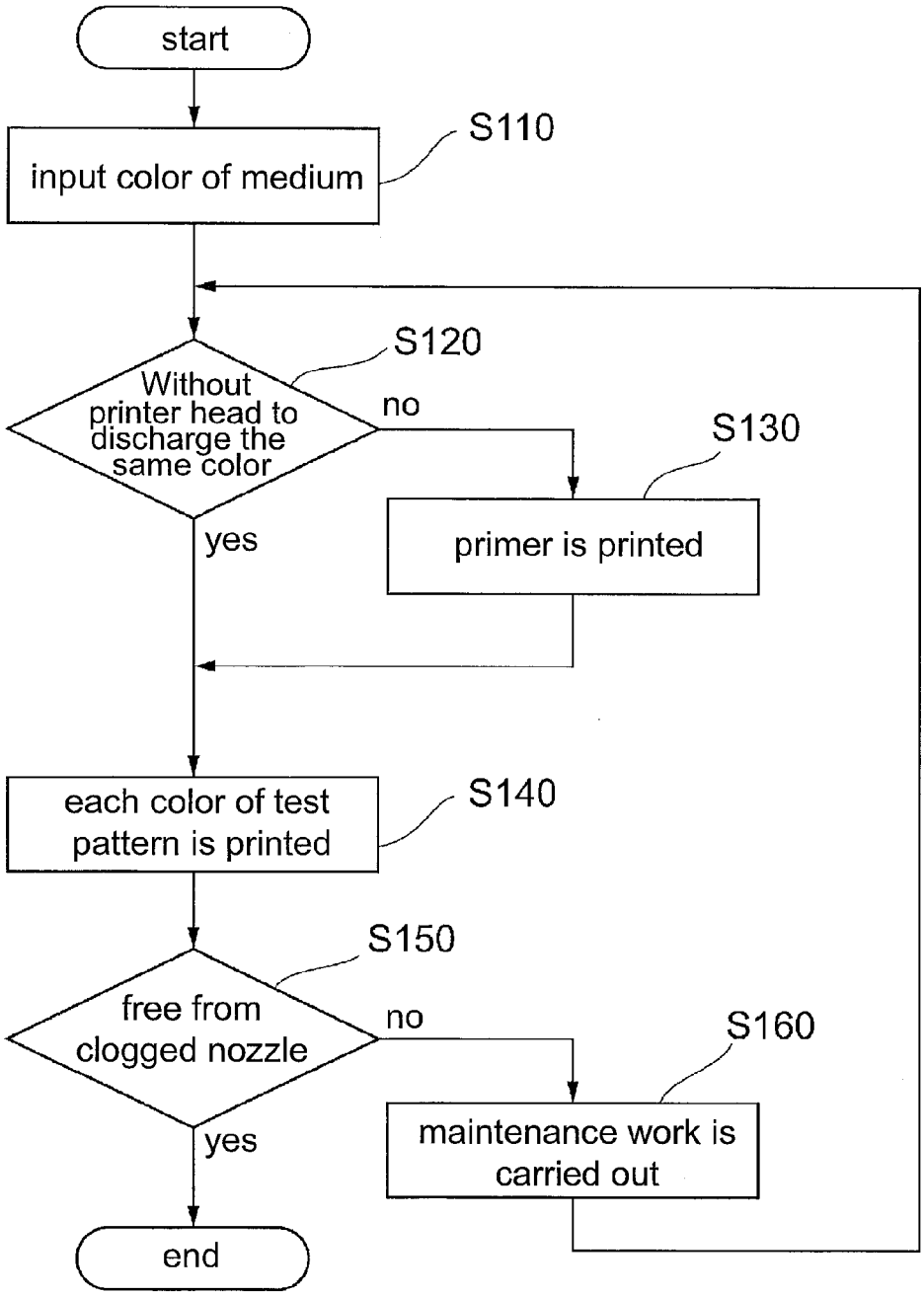
FIG. 5 is a flowchart of test pattern printing operation according to the first embodiment.

Subsequently, operation progresses to a step 150, and then the user examines the printed test patterns in order to check for presence of any clogged nozzle. If a test pattern is printed under a normal condition having each discharge nozzle without any clogging, a plurality of lines stretching in a left-and-right direction are printed, being placed at regular intervals in a front-back direction as shown in FIG. 4A. At this time, in the pattern print area 51, since a linear test pattern is printed with the white ink on the primer print prepared with the black ink, printing conditions of the white test pattern can visually be checked clearly. Then, if the user checks that the test patterns are printed without any missing line in all the pattern print areas from 51 through 55 (i.e., YES judged in a step S150), the operation workflow finishes.

Figure 4B:
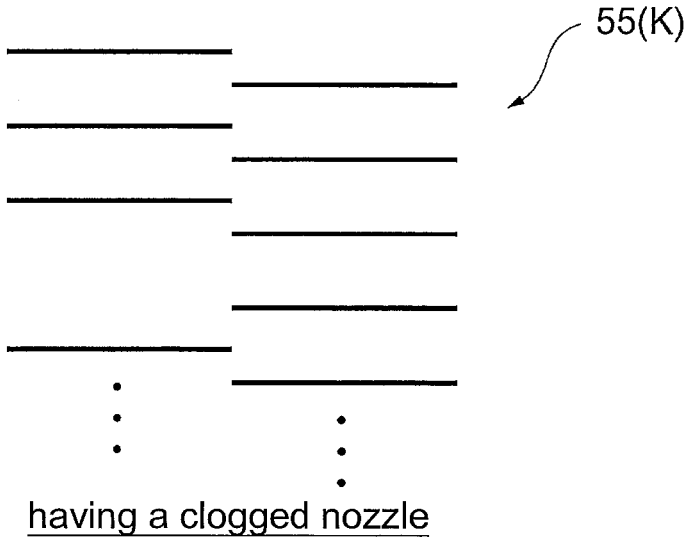

On the other hand, if a test pattern is printed under a condition having some discharge nozzle clogged, the printed test pattern includes a partially missing line, for example as shown in FIG. 4B. When there exists some missing line in this way at a certain section even though it is just one line missing, the line intervals in the front-back direction become altered only in the section. Therefore, the user can visually check for presence of any clogged nozzle with ease. When FIG. 4B is compared to FIG. 4A, a line 55*a* printed in FIG. 4A is missing in FIG. 4B. Accordingly, it is judged that a discharge nozzle corresponding to the line 55*a* is not free from clogging (i.e., NO judged in the step S150), and then operation progresses to a step S160.

As operation progresses to the step S160, the user operates the operation section 13*a* in order to eliminate clogging of the nozzle clogged, and inputs a maintenance command into the control unit 40. Then, according to the command, the head unit 20 moves along the guide rail 15*a* toward the left so as to be face-to-face with the maintenance unit 30 in a vertical direction. Under the condition, the cap driving motor 39 is driven so that the bottom side surface of the printer head 22 is covered with the cap component. Then, the suction pump operates for a certain time period so that a negative pressure acts on the bottom side surface of the printer head 22 to remove ink hardened at a tip of the discharge nozzle, and dust and so on adhering to a surrounding area of the discharge nozzle. Afterward, operation progresses to the step S120.

Then, in the same manner as described above, operation progresses from the step S120 to the step S130, from the step S130 to the step S140, and from the step S140 to the step S150. If it is judged in the step S150 that there exists no clogged nozzle, the operation workflow finishes. In the meantime, if it is judged that the clogging of the clogged nozzle is not yet eliminated, the user repeats the maintenance operation and the test pattern printing operation. Thus, until it is judged in the step S150 that there exists no clogged nozzle, the maintenance operation and the test pattern printing operation are repeated. Then, the operation workflow finishes.

Incidentally, at the time of checking for any clogged nozzle, conventionally the white medium 'WM' for printing work is once replaced with a transparent medium for printing a test pattern, and the test pattern is printed on the transparent medium for checking it. Therefore, each time of the checking work, unfortunately it is needed to replace the medium of the printing device so that the checking work is likely to become complicated, and furthermore the work efficiency is prone to become reduced. On the other hand, in the case of the printing device 10 according to the present invention; by means of a simple method including just a slight modification with respect to the control at the time of printing the test pattern without any additional new component and the like, it becomes unnecessary to replace the medium at the time of checking for any clogged nozzle. Accordingly, a simplification of the checking work can be aimed; and furthermore accompanied by the simplification, an improvement of the work efficiency of entire printing work can be implemented. Moreover, with respect to the primer, the control unit 40 makes a setting through selecting a color of ink that is in relation of a complementary color for the primer. Therefore, the user can visually check the test pattern overprinted on the primer more clearly, and becomes able to detect any clogged nozzle for sure.

Second Embodiment

Explained below is a printing device 60 according to a second embodiment. The printing device 60 has the same configuration as the printing device 10 described above does, except for a point that primer-printing procedures at the time of printing a test pattern are somewhat different. Then, the primer-printing procedures are mainly explained with reference to FIG. 6A through FIG. 6C.

Figure 6A:
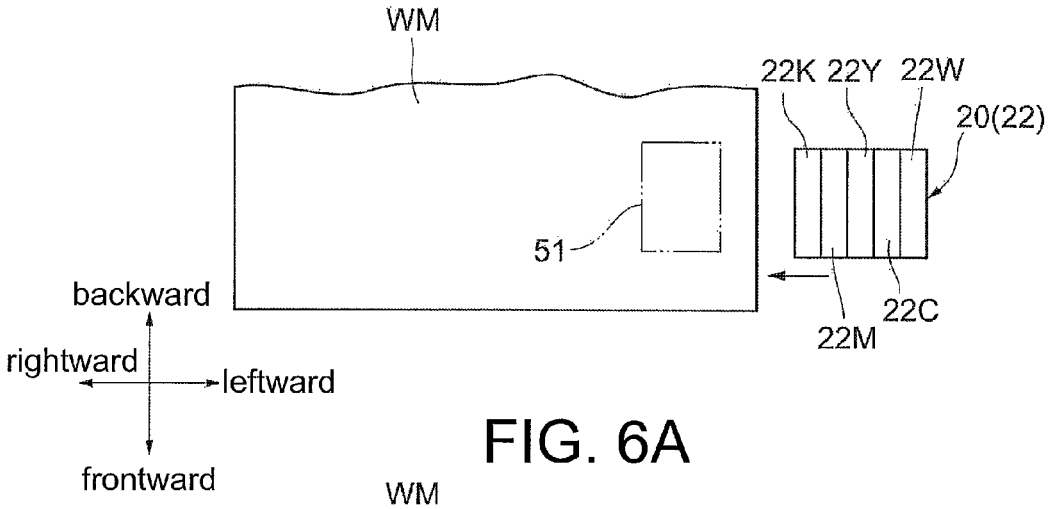
Figure 6B:
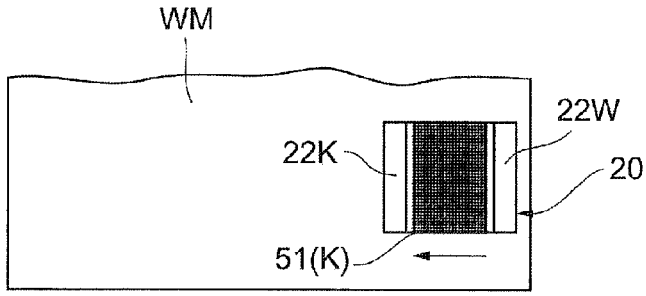
Figure 6C:
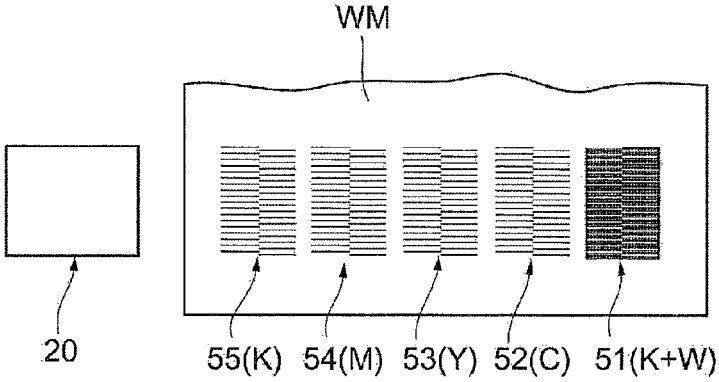

At first, the head unit 20 is positioned on the left side of the pattern print area 51, as shown in FIG. 6A. On this occasion, it is assumed that the black head 22K to discharge the black ink for a primer is mounted at a place to the right of the white head 22W in the head unit 20. While the head unit 20 is moving toward the right under the condition, discharging operation is controlled in such away that a discharge nozzle of the black head 22K discharges black ink at the time when the black head 22K passes above the pattern print area 51. Through the operation, the black ink is applied all over the pattern print area 51 (an entire section of the area) for printing the primer, as shown in FIG. 6B. Due to a reason on a structure of the head unit 20, the white head 22W passes above the pattern print area 51, after the primer is printed. Then, at the time, a test pattern is printed by means of discharging white ink onto the pattern print area 51 on which the primer is already printed (refer to FIG. 6C).

As described above, in the case of the printing device 60 as well, the test pattern is printed with the white ink on the primer that is prepared with the black ink, and therefore it is possible to easily check for any clogged nozzle of a printer head that discharges ink of the same color as a color of a medium. Furthermore, in the case of the printing device 60, while the head unit 20 moves once (a movement of only one stroke) in the left-and-right direction, all the test patterns including the primer can be printed. Therefore, it becomes possible to carry out checking for any clogged nozzle efficiently in a short time.

Third Embodiment

Explained below is a printing device 70 according to a third embodiment. The printing device 70 has the same configuration as the printing device 10 described above does, except for a point that primer-printing procedures and a shape of a primer are different. Then, the primer-printing is mainly explained with reference to FIG. 7A through FIG. 7C.

Figure 7A:
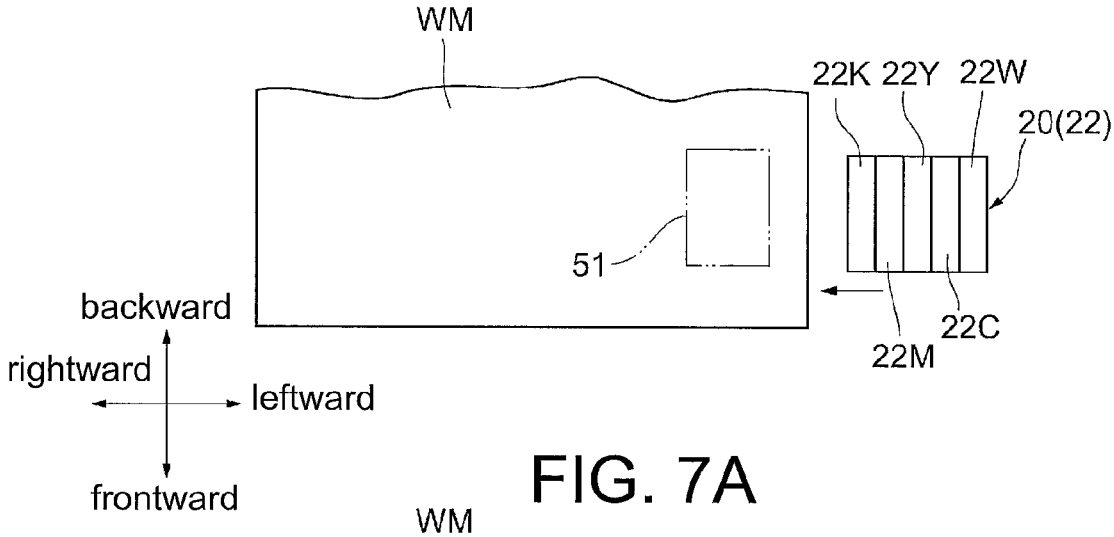
Figure 7B:
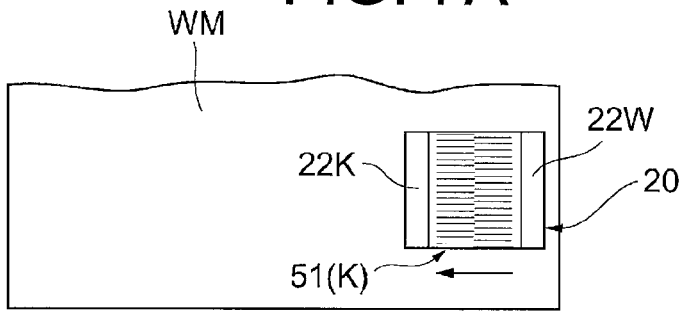
Figure 7C:
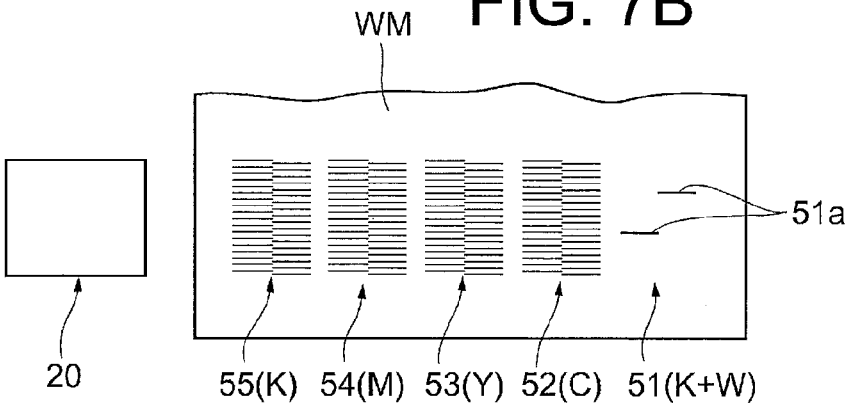

At first, the head unit 20 is positioned on the left side of the pattern print area 51, as shown in FIG. 7A. A layout in the printer head 22 on this occasion is the same as that of the printing device 60 described above. While the head unit 20 is moving toward the right under the condition, discharging operation is controlled in such away that a discharge nozzle of the black head 22K discharges black ink at the time when the black head 22K passes above the pattern print area 51. Through the operation, the black ink is applied to the pattern print area 51 in a form of lines stretching in a left-and-right direction, in order to print a primer, as shown in FIG. 7B. Subsequently, when the white head 22W passes above the pattern print area 51, white ink is discharged onto the pattern print area 51 so as to print a test pattern in the same shape as the primer (refer to FIG. 7C).

As a result, if discharge nozzles of the white head 22W have no clogging, the white ink is applied and piled up on all the lines of the primer that have been already printed with the black ink. Therefore, when the pattern print area 51 is examined, an entire section of the area looks white, and presence of any clogged nozzle can be checked easily. On the other hand, if the discharge nozzles of the white head 22W have clogging, parts of the lines of the primer printed with the black ink are seen, for example as a line 51*a* shown in FIG. 7C. Then, also in this case, presence of any clogged nozzle can be checked easily.

Having competence of the printing devices 10 and 60 described above, moreover the printing device 70 is able to reduce the amount of ink to be used for printing the primer since the primer is printed in the form of lines, so that running costs can be cut.

Although explained in the first embodiment through the third embodiment are configurations in which, for example, the user makes a judgment on the color of the medium 'M' and inputs the judged color into the control unit 40, the present invention is applied, not being only limited to those configurations. Alternatively, for example, applied can be a configuration in which a color detection section 80 is mounted on the carriage 21, instead of the configuration that includes inputting the color of the medium 'M' by the user; the color detection section 80 being equipped with a light-launching section and a light-receiving section so as to be able to detect the color of the medium 'M' (refer to FIG. 2). According to such a configuration, at first, while the color detection section 80 scans the medium 'M', the light-launching section launches a light beam, to be reflected by a surface of the medium 'M', and the light-receiving section receives the reflected light beam. At the time, the reflected light beam received by the light-receiving section includes characteristics corresponding to the surface color of the medium 'M', and then the color of the medium 'M' can automatically be detected through making an analysis of the characteristics by the control unit 40. Therefore, a workload of the user can be lightened so that the work efficiency can be improved.

Although explained in the first embodiment through the third embodiment are configuration examples in which the 5-color printer head is mounted, the present invention is applied, not being only limited to those configuration examples. Alternatively, as required, the present invention can also be applied to a configuration including additional printer heads, for example, which individually discharge ink of light cyan that is a color lighter than cyan, and ink of light magenta that is a color lighter than magenta. Moreover, for example, when a test pattern is printed on a medium that is colored closely to light cyan, the control unit 40 automatically specifies light magenta, which is in relation of a complementary color to light cyan, as a color of a primer for a pattern print area where the test pattern is printed in light cyan. In this way, according to a color of a medium to be used for printing work as well as a printer head mounted, ink to be used for a primer print is specified, as required.

Although exemplified in the first embodiment through the third embodiment are configurations in which the test pattern is printed in a form of lines stretching in the left-and-right direction, the test pattern is not limited to the form. A form of a test pattern is not limited to anything, as far as ink discharge condition of each discharge nozzle can be checked.

Although a configuration example in which the present invention is applied to the printing device 10 including a medium transfer by a single axis and a printer head transfer by a single axis is explained in the embodiment described above, as an example of a printing device to which the present invention is applied; the present invention is applied, not being only limited to the configuration. Alternatively, the present invention can be applied, for example, to a printing device of a so-called flat bed type equipped with a printer head of a double-axis transfer type, and also a printing device of a double-axis medium transfer type. Furthermore, with respect to ink to be used, the present invention can be applied to a printing device using various kinds of ink; such as ultraviolet curing ink, water-based ink, and the like. The above-described printing device equipped with a printer head of a double-axis transfer type includes, for example: a flat bed being planer and able to fix a medium by chucking, a guide rail so provided as to be movable above the flat bed in a front-back direction, and a printer head so provided as to be movable along the guide rail in a left-and-right direction. Then, printing work is carried out by means of controlling a ink discharge from the printer head while making a combination of a motion of the guide rail moving in the front-back direction and a motion of the printer head moving in the left-and-right direction, with a medium being fixed by chucking on the flat bed.

The invention claimed is:

1. A printing device, comprising:

a medium supporting means for supporting a sheet print medium;

a printer head, installed to a guide rail in such a way as to freely reciprocate, for discharging ink from a discharge nozzle so formed as to face downward, the guide rail being provided at a position above the medium supporting means; and a test print setting means for setting a test pattern of each color to be printed by discharging ink from the discharge nozzle, and a pattern print area in the print medium where the test pattern is printed;

wherein the printing device prints on the print medium by making a combination of a motion of the printer head reciprocating along the guide rail and an operation of discharging ink from the discharge nozzle toward the print medium supported by the medium supporting means;

the printer head includes a plurality of specific-color printer heads individually corresponding to each color; and the test print setting means makes a setting in such a way that, for the pattern print area where the test pattern is printed by discharging ink of a nearly-identical color as a color of the print medium, the test pattern is printed with the ink of the nearly-identical color on a primer print prepared with ink of a color other than the nearly-identical color.

2. The printing device according to claim 1, wherein, the printer head includes at least one of the specific-color printer heads, for discharging black ink, as well as another one of the specific-color printer heads, for discharging white ink; and the test print setting means makes a setting in such a way that, for the pattern print area where the test pattern is printed by discharging white ink onto a white medium, the test pattern is printed with the white ink on a primer print prepared with the black ink.

3. A printing method using a printing device for printing on a print medium by making a combination of a motion of a printer head reciprocating along a guide rail and an operation of discharging ink from a discharge nozzle of the printer head toward the print medium supported by a medium supporting means, the guide rail being positioned above the medium supporting means for supporting the print medium, the printing method comprising:

a first step in which, for a pattern print area where a test pattern is printed by discharging ink of a nearly-identical color as a color of the print medium, a primer print is prepared with ink of a color other than the nearly-identical color; and a second step in which the test pattern is printed with the ink of the nearly-identical color on the primer print prepared in the first step.

* * * * *